US007261273B2

(12) United States Patent
Lemire

(10) Patent No.: US 7,261,273 B2
(45) Date of Patent: Aug. 28, 2007

(54) HOOK & CORD LOOP HANGING SYSTEM

(76) Inventor: Robert J. Lemire, P.O. Box 299, Kings Park, NY (US) 11754

( * ) Notice: Subject to any disclaimer, the term of this patent is extended or adjusted under 35 U.S.C. 154(b) by 124 days.

(21) Appl. No.: 11/337,846

(22) Filed: Jan. 23, 2006

(65) Prior Publication Data

US 2006/0118692 A1 Jun. 8, 2006

Related U.S. Application Data

(62) Division of application No. 10/806,017, filed on Mar. 23, 2004, now Pat. No. 7,011,283.

(51) Int. Cl.
*A47G 1/24* (2006.01)

(52) U.S. Cl. ..... 248/476; 248/495

(58) Field of Classification Search ..... 248/476, 248/495, 480, 493, 475.1
See application file for complete search history.

(56) References Cited

U.S. PATENT DOCUMENTS 3,251,569 A * 5/1966 Rynearson ..... 248/493
3,788,588 A * 1/1974 Tendler ..... 248/467
4,863,135 A * 9/1989 Mellor et al. ..... 248/328
4,892,284 A * 1/1990 Kelrick ..... 248/476
5,806,826 A * 9/1998 Lemire ..... 248/476
5,931,439 A * 8/1999 Lemire ..... 248/493
5,947,438 A * 9/1999 Lemire ..... 248/476
6,062,525 A * 5/2000 Lemire ..... 248/475.1
6,334,602 B1 * 1/2002 Clarke ..... 248/495
6,405,466 B1 * 6/2002 Lemire ..... 40/757
7,011,283 B2 * 3/2006 Lemire ..... 248/476

* cited by examiner

*Primary Examiner*—Amy J. Sterling
(74) *Attorney, Agent, or Firm*—Tillman Wright, PLLC; James D. Wright; Chad D. Tillman

(57) ABSTRACT

Objects hung with the improved hook & cord loop hanging system uses one or more adjustable hooks for changing the length of one or more flexible cord loops. This hanging system is an improvement over the hangers described in U.S. Pat. No. 5,947,438. Each improved hanger can either be affixed to the object or to the surface the object is being hung on. The cord loop or loops interface with various supports connecting to or affixed to the object or to the surface when the hanger is on the object. The single hook and single cord configuration provides vertical adjustability by shortening the length of the cord through the turning of the screw the adjustable hook is ridding on. A single hook and double cord configuration provides support and locking for the object. A double hook and double cord configuration provides vertical adjustability and locking capability These hangers can be used alone for small objects or in pairs for larger or heavier objects.

3 Claims, 4 Drawing Sheets

HOOK & CORD LOOP HANGING SYSTEM

This application is a DIVISIONAL of application Ser. No. 10/806,017 dated Mar. 23, 2004 now U.S. Pat. No. 7,011, 283 and is an improvement over U.S. Pat. No. 5,947,438. FIG. 1 in U.S. Pat. No. 5,947,438 shows adjustable hooks 14 AA and 14BA with cord 116 hanging down and hook 118 fastened to the end of it. The improvements cited in this application deal with the number and configurations of the hooks and cords shown in that drawing. Some may consider the improvements to be obvious; however, this application is considered to provide significant new matter that is not covered by that patent.

BACKGROUND OF THE INVENTION

Field of the Invention

This invention generally relates to objects hung on a surface, such as pictures, mirrors, plaques, etc.

SUMMARY OF THE INVENTION

It is the object of the present invention to provide useful means for hanging objects with adjustable cord loops for positioning and locking objects onto a surface. This application is a DIVISIONAL of application Ser. No. 10/806,017 dated Mar. 23, 2004

The first item is the use of a cord loop formed by extending the cord from one side of the hanger to the other. By having an adjustable loop the hanger can then interface with a number of different brackets for supporting an object. An "S" type hook can be used on the cord loop, or a bracket can be affixed to the object so that the bracket or hook from the object hangs on the loop from the hanger. The head of one or more protruding screws can also be used to support the object. Furthermore, the bracket can interface with the body of the hanger so that the object is locked onto the hanger. (This species has been allowed and the patent will issue shortly)

(The next two paragraphs deal with the species that is being submitted as the 'Divisional' of the previous election)

The second item is the use of two cords forming a top and a bottom loop with a common adjusting hook in the hanger body. With this arrangement the object can be locked onto the surface when the loops are tightened against a double wall bracket or top and bottom hooks on the object when the hanger is affixed to the wall.

The third item is the use of two cords forming top and bottom loops with top and bottom adjusting hooks in the hanger body. With this arrangement the object can be positioned vertically to a desired level by the supporting loop and then locked into place by tightening the second loop. When the hanger is affixed to a wall the lower loop is the support loop and the top loop provides a range of top tilting until the loop is drawn tight and the object becomes locked onto the hanger.

BRIEF DESCRIPTION OF DRAWINGS

FIG. 1 is (Withdrawn)

FIG. 2 is (Withdrawn)

DETAILED DESCRIPTION

FIG. 1 has been withdrawn.

FIG. 2 has been withdrawn

Figure 3:
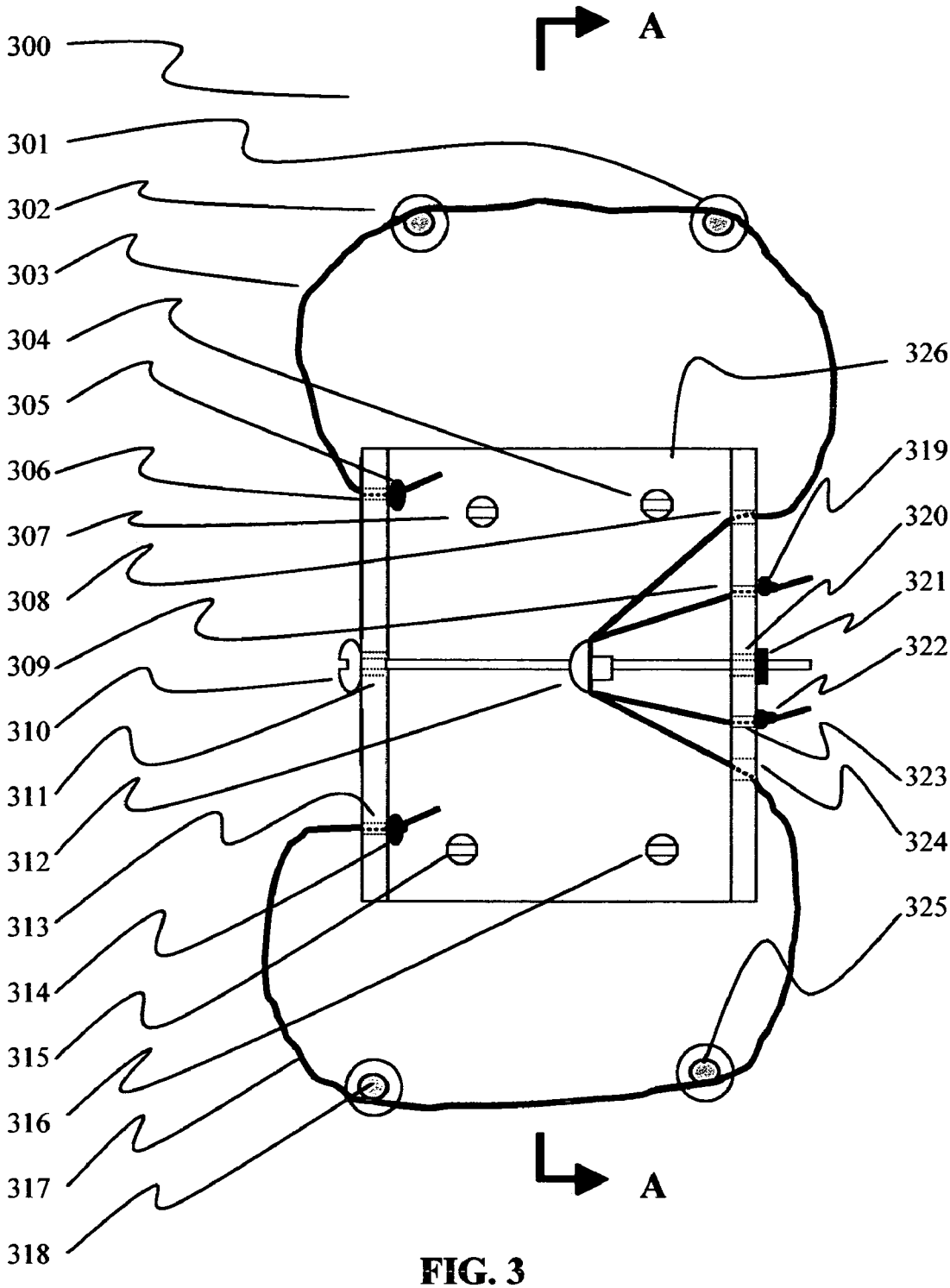
FIG. 3 is a front elevational view taken from the back surface of an object with four screw heads interfacing with a double loop hanger having one adjusting hook and fastened to the wall.

FIG. 3 shows hanger assembly from the back edge of an object having protruding screws 301, 302, 318 and 325 engaging cord loops 303 and 317 extending beyond the top and bottom of hanger body 326. The hanger body 326 is affixed to a surface with screws 304, 307, 315 and 316. The hanger body is made from a U-channel and has apertures 311 and 320 through which screw 310 goes. Screw 310 has hook 312 threadably engaged to it and is held in position by retainer 321. Top cord 303 is knotted at 305 and goes through apertures 306, 308, and 323. It forms a top loop between 306 and 308 that goes over screws 301 and 302. Cord 303 then enters the body through aperture 308 and goes over hook 312 and then out through aperture 323 where it is knotted at 322. The bottom cord 317 forms a loop by being knotted at 314 and going through aperture 313, over screws 318 and 325, then into aperture 324. It then goes over hook 312 and exits the body at aperture 309 where it is knotted at 319.

Turning screw 310 simultaneously changes the length of the top and bottom loops. The top loop supports the object and the bottom loop locks the object onto the hanger.

Figure 4:
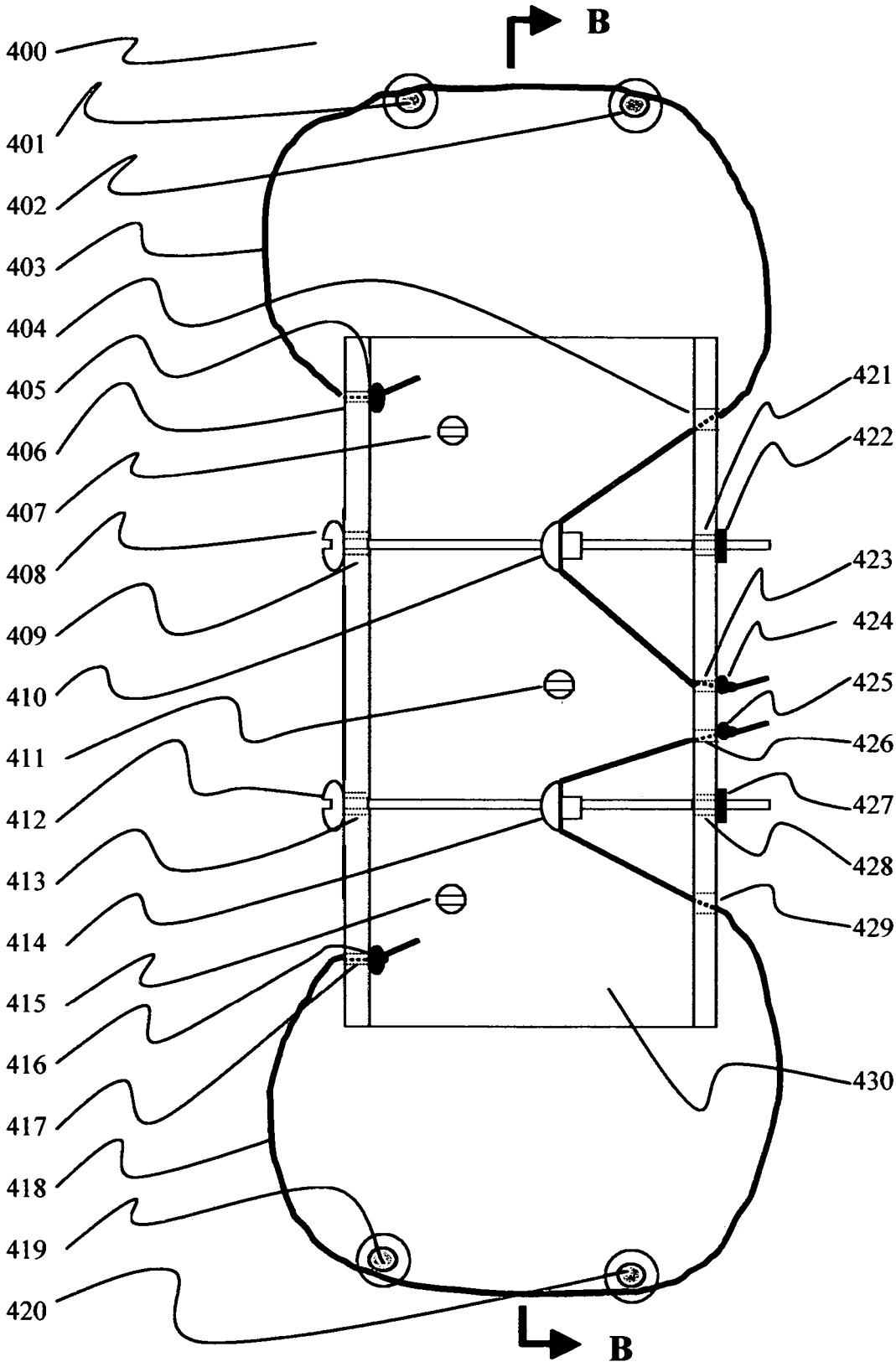
FIG. 4 is a front elevational view taken from the back surface of an object with four screw heads interfacing with a double loop hanger having two adjusting hooks and fastened to the wall.

FIG. 4 shows hanger assembly 400 having top cord 403 going over screws 401 and 402 that are protruding from the back of an object. The hanger body 430 is affixed to a surface with screws 407,411, and 415. The body has two screws and hooks. Top screw 408 goes through apertures 409 and 421. It has hook 410 threadably engaged on it and is retained by 422. Cord 403 is knotted at 405 and goes through apertures 406, 404, and 423. Between apertures 404 and 423 the cord goes over hook 410 and adjusts the length of the top loop as the screw 408 is turned and hook 410 moves on it. Bottom screw 412 goes through apertures 413 and 428. It is retained by 427 and has hook 414 threadably engaged on it. Bottom cord 418 starts at 416, goes through aperture 417, then over screws 419 and 420 that are protruding from the back of the object, and into aperture 429. From aperture 429 the cord goes over hook 414 and exits hanger body 430 at aperture 426 where it is knotted at 425.

Turning screw 412 changes the vertical position of the object by reducing the length of the bottom loop. Turning screw 408 changes the length of the top loop and initially alters the amount of top lean the object has with respect to a vertical surface until the cord is tightened against screws 401 and 402. The combined action of the two loops is to provide support, positioning and locking capability.

Figure 5:
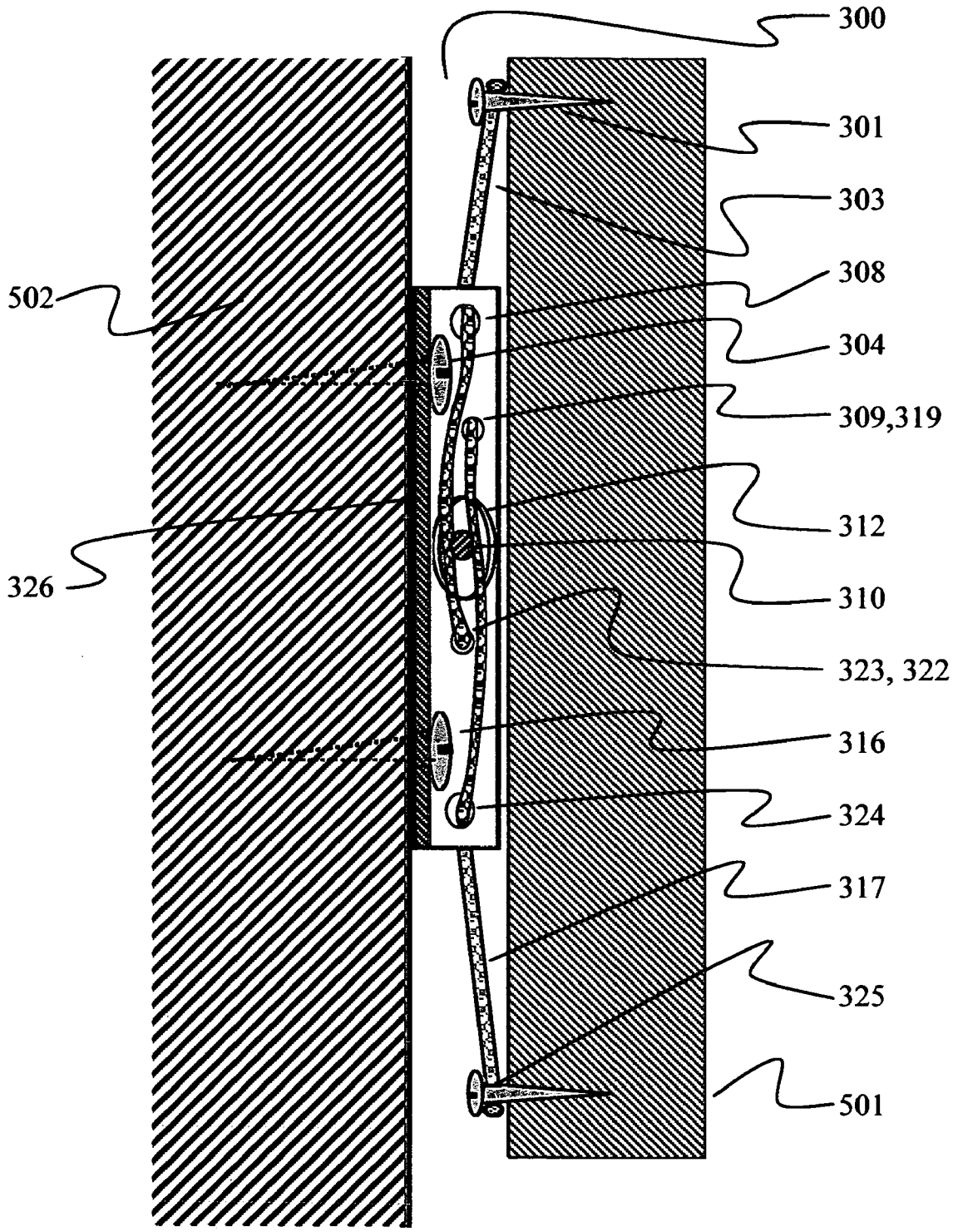
FIG. 5 is section A—A of FIG. 3.

FIG. 5 is section A—A found on FIG. 3 in which like numerals represent like parts. Hanger assembly 300 is composed of protruding screws 301 and 325 in the top and bottom of object 501 for engaging cord loops 303 and 317 extending beyond the top and bottom of hanger body 326. The hanger body 326 is affixed to a wall 502 with screws 304 and 316. The hanger body is made from a U-channel and has aperture 320 through which screw 310 goes. Screw 310 has a hook 312 threadably engaged to it. Top cord 303 forms a top loop that goes over screw 301. Cord 303 then enters the body through aperture 308 and goes over hook 312 and then out through aperture 323 where it is knotted at 322. The bottom cord 317 forms a loop that goes over screw 325, then into aperture 324. It then goes over hook 312 and exits the body at aperture 309 where it is knotted at 319.

Figure 6:
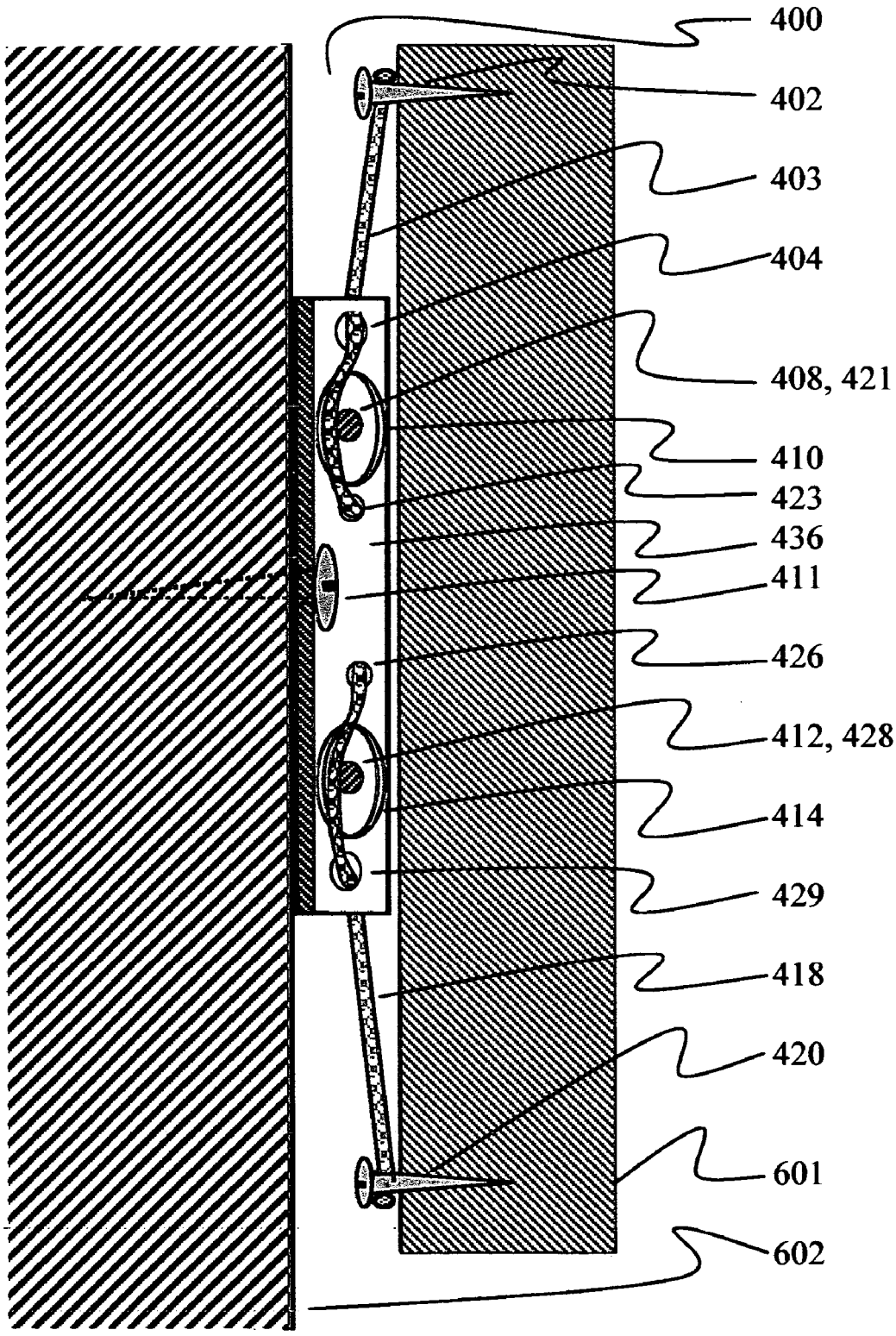
FIG. 6 is section B—B of FIG. 4.

FIG. 6 is section B—B found on FIG. 4 in which like numerals represent like parts. Hanger assembly 400 is composed of top cord 403 going over screw 402 that is protruding from the back of object 601. The hanger body 430 is affixed to a wall 602 with screw 411. The body has screws 408 and 412 with hooks 410 and 414 threadably engaged on them. Top screw 408 goes through aperture 421 and has a hook 410 threadably engaged on it. Cord 403 is shown over screw 402, it then goes through apertures 404, and 423. Between apertures 404 and 423 the cord goes over hook 410 and is used to adjust the length of the top loop as the screw 408 is turned and hook 410 moves on it. Bottom screw 412 goes through aperture 428 and has hook 414 threadably engaged on it. Bottom cord 418 goes around screw 420 that is protruding from the back of the object, and then into aperture 429. From aperture 429 the cord goes over hook 414 and exits hanger body 430 at aperture 426 where it is knotted. Turning screw 412 adjusts the length of the bottom loop as hook 414 moves on it. The bottom cord loop supports the object 601 at a height determined by the length of the bottom cord loop 418, while the top cord loop 403 is used for locking the object 601 onto the hanger body 430.

While the invention has been illustrated and described in the above specification it is not intended to be limited to the details shown, since it will be understood that various omissions, modifications, substitutions, and changes in the form and details of the devices illustrated can be made by those skilled in the art without departing from the spirit of the present invention. For instance, the hangers can be affixed to the object and the loops engage supports affixed to a surface; the hangers can be affixed to the middle of small objects or one on each side for larger objects; and the cords can also have a number of hooks going over them or on them for holding the object onto the hanger.

What I claim is:

1. A hanging system for supporting and locking an object on to a wall comprising:

a. A U-shaped channel hanger body having a flange for affixing the hanger body to the wall, the flanges having opposing first and second side legs in a vertical direction and having apertures through the first and second side legs, b. an adjusting means extending through apertures in the first and second side legs;

c. a top flexible cord affixed to a first side leg of the hanger body adapted to extend over a top of supports affixed to an object, the top flexible cord extending in a loop to the second side leg of the hanger body where it enters a space between the first and second side legs and lies over the adjusting means and loops down through an aperture in the second side where the cord is affixed to the hanger body such that the cord forms a top loop between the legs and a V-shaped loop between the adjusting means and the second side of the hanger body;

d. a bottom flexible cord affixed to a first side of the hanger body, adapted to extend over a bottom of supports affixed to an object, the bottom flexible cord extending in a loop to the second side of the hanger body where it enters the spaced between the first and second side legs and lies over the adjusting means and loops up through an aperture in the second side where the cord is affixed to the hanger body such that the bottom cord forms a bottom loop between the legs and a V-shaped loop between the adjusting means and the second side of the hanger body;

e. wherein the adjusting means can shorten or lengthen the top and bottom V-shaped loops such that an object can be held in the top and bottom flexible cords and can be locked onto the hanging system.

2. The system of claim 1 wherein the adjusting means is composed of a single horizontal screw slidingly engaged through right and left apertures in the legs of the hanger body, said screw having a threaded hook affixed to it in the space between the side legs of the hanger body such that the top and bottom cords entering the second side of the hanger go over the hook and back down to the second side where they are affixed to the hanger body and form V-shaped loops between the hook and the second side of the hanger body, whereby turning the screw changes the length of the exterior cord loops for supporting and locking the object onto the hanger.

3. The system of claim 1 wherein the adjusting means is composed of a top and a bottom horizontal screws slidingly engaged through right and left apertures in the legs of the hanger body, said screws having a threaded hook affixed to them in the space between the side less of the hanger body such that the top cord entering the second side of the hanger goes over the top hook and back down to the second side where it is affixed to the hanger body and forms a top V-shaped loop between the top hook and the second side of the hanger body, and the bottom cord entering the second side of the hanger goes over the bottom hook and back down to the second side where it is affixed to the hanger body and forms a bottom V-shaped loop between the bottom hook and the second side of the hanger body; whereby turning the screws changes the length of the exterior cord loops for supporting and locking the object onto the hanger.

* * * * *